US008747066B2

(12) United States Patent
Ström et al.

(10) Patent No.: US 8,747,066 B2
(45) Date of Patent: Jun. 10, 2014

(54) GAS TURBINE HOUSING COMPONENT

(75) Inventors: Linda Ström, Trollhättan (SE); Jonas Lindskog, Svabnesund (SE); Per Widström, Grästorpäg (SE)

(73) Assignee: Volvo Aero Corporation, Trollhättan (SE)

( * ) Notice: Subject to any disclaimer, the term of this patent is extended or adjusted under 35 U.S.C. 154(b) by 741 days.

(21) Appl. No.: 12/919,818

(22) PCT Filed: Mar. 18, 2008

(86) PCT No.: PCT/SE2008/000205

§ 371 (c)(1),
(2), (4) Date: Aug. 27, 2010

(87) PCT Pub. No.: WO2009/116898

PCT Pub. Date: Sep. 24, 2009

(65) Prior Publication Data

US 2011/0002778 A1 Jan. 6, 2011

(51) Int. Cl.
*F01D 25/24* (2006.01)

(52) U.S. Cl.
USPC ..... 415/214.1; 415/191; 415/208.1

(58) Field of Classification Search
USPC ..... 415/119, 134, 214.1, 213.1, 215.1, 135, 415/139, 208.1, 208.2, 209.3, 220, 191
See application file for complete search history.

(56) References Cited

U.S. PATENT DOCUMENTS

| | | | | |
|---|---|---|---|---|
| 2,472,062 | A * | 6/1949 | Boestad et al. | 415/139 |
| 2,848,156 | A * | 8/1958 | Oppenheimer | 415/108 |
| 6,537,022 | B1 * | 3/2003 | Housley et al. | 415/189 |
| 6,705,832 | B2 * | 3/2004 | Tiemann | 415/116 |
| 2002/0168263 | A1 | 11/2002 | Bolms | |
| 2003/0012643 | A1 | 1/2003 | Tiemann | |
| 2004/0051254 | A1 | 3/2004 | Smed | |
| 2004/0052637 | A1 | 3/2004 | Paprotna et al. | |
| 2005/0082768 | A1 | 4/2005 | Iguchi et al. | |

OTHER PUBLICATIONS

International Search Report for corresponding International Application PCT/SE2008/000205.
International Preliminary Report on Patentability for corresponding International Application PCT/SE2008/000205.
Supplementary European Search Report (May 23, 2013) for corresponding European App. EP 08 74 1831.

* cited by examiner

*Primary Examiner* — Nathaniel Wiehe
*Assistant Examiner* — Aaron Jagoda
(74) *Attorney, Agent, or Firm* — WRB-IP LLP

(57) ABSTRACT

A gas turbine housing component includes a wall structure including two adjacent wall parts and a connection arrangement arranged between adjacent edges of the two wall parts. The connection arrangement includes an elongated seal strip positioned along the wall part edges and bridging the distance between the wall part edges.

16 Claims, 5 Drawing Sheets

GAS TURBINE HOUSING COMPONENT

BACKGROUND AND SUMMARY

The present invention relates to a gas turbine housing component comprising a wall structure, wherein the wall structure comprises two adjacent wall parts and a connection arrangement arranged between adjacent edges of the two wall parts. The invention is further directed to a gas turbine engine, and especially to an aircraft engine, comprising the component. Thus, the invention is especially directed to a jet engine.

Jet engine is meant to include various types of engines, which admit air at relatively low velocity, heat it by combustion and shoot it out at a much higher velocity. Accommodated within the term jet engine are, for example, turbojet engines and turbofan engines. The invention will below be described for a turbofan engine, but may of course also be used for other engine types.

An aircraft gas turbine engine of the turbofan type generally comprises a forward fan and booster compressor, a middle core engine, and an aft low pressure power turbine. The core engine comprises a high pressure compressor, a combustor and a high pressure turbine in a serial relationship. The high pressure compressor and high pressure turbine of the core engine are interconnected by a high pressure shaft. The high-pressure compressor is rotatably driven to compress air entering the core engine to a relatively high pressure. This high pressure air is then mixed with fuel in the combustor and ignited to form a high energy gas stream.

The gas stream flows aft and passes through the high-pressure turbine, rotatably driving it and the high pressure shaft which, in turn, rotatably drives the high pressure compressor.

The gas stream leaving the high pressure turbine is expanded through a second or low pressure turbine. The low pressure turbine rotatably drives the fan and booster compressor via a low pressure shaft. The low pressure shaft extends through the high pressure rotor. Most of the thrust produced is generated by the fan.

Annular gas turbine housing components are adapted to define the primary gas flow channel through the engine and other annular compartments in the engine. Such annular compartments have different purposes and often have different internal pressure during operation. The wall parts may be formed by castings. Different wall parts are interconnected in order to form the component and finally the engine. Depending on the position of such walls, they are subjected to a high thermal load during operation. This may lead to a thermal distortion between the connected walls during operation. Further, due to the temperature environment, high temperature alloys are used, which are difficult to machine by conventional methods. Adjacent wall parts have traditionally been interconnected via bolted connections.

It is desirable to achieve a gas turbine housing component comprising a wall structure, which creates conditions for an improved connection between interconnected walls with regard to sealing. The component should further be cost-efficient in production while maintaining or improving its operational characteristics.

According to an aspect of the present invention, a connection arrangement comprises an elongated seal strip positioned along the wall part edges and bridging the distance between the wall part edges.

Especially, an aspect of the invention allows for sliding between the wall parts during operation which is necessary in the temperature application due to the thermal expansion.

Further, the invention has multiple seal surfaces. It is particularly preferred for designs with a lateral joint between the wall parts. Further, an aspect of the invention creates conditions for simplified machined fairing castings.

Preferably, the seal strip is positioned in an overlapping state relative to both wall parts. Further, the seal strip is adapted to contact the wall parts in a sealing manner.

According to a preferred embodiment, the connection arrangement comprises a support means, which is connected to the seal strip and adapted to hold the seal strip in the position along the wall part edges, and that the seal strip and the support means contact the wall parts on opposite sides thereof. By this arrangement, the seal strip may be pressed against the wall part edges by means of the support means, wherein the sealing function is improved.

According to a further preferred embodiment, the support means comprises at least one elongated support strip. This embodiment creates conditions for using a minimum number of parts in order to seal between the wall parts. The seal strip and the support strip are preferably interconnected so that a gap between the wall parts is enclosed and sealed.

The support strip preferably forms a flexible element, i.e a spring element. Preferably, the support means and the seal strip are connected in such a manner that the seal strip is pressed against both wall parts.

According to a further preferred embodiment, the seal strip comprises a first portion bridging the distance between the wall part edges on a first side of the wall parts and a second portion projecting from the first portion between the wall part edges, preferably to a position on a second side of the wall parts. The second portion of the seal strip is thereby exposed to the other side of the wall parts and thereby available for connection to the support means.

According to a further development of the last mentioned embodiment, the support means comprises at least one through hole, and a part of the second portion of the seal strip extends through said hole. This design creates conditions for an efficient connection (and sealing contact) between the seal strip and the support means. Preferably, the second portion of the seal strip comprises at least two fingers, which act on the support means on opposite sides of the through hole. This creates conditions for a central positioning of the seal strip with regard to the support means and the gap between the wall parts.

Other advantageous features and functions of various embodiments of the invention are set forth in the following description.

BRIEF DESCRIPTION OF THE DRAWINGS

The invention will be explained below, with reference to the embodiment shown on the appended drawings, wherein.

DETAILED DESCRIPTION

Figure 1:
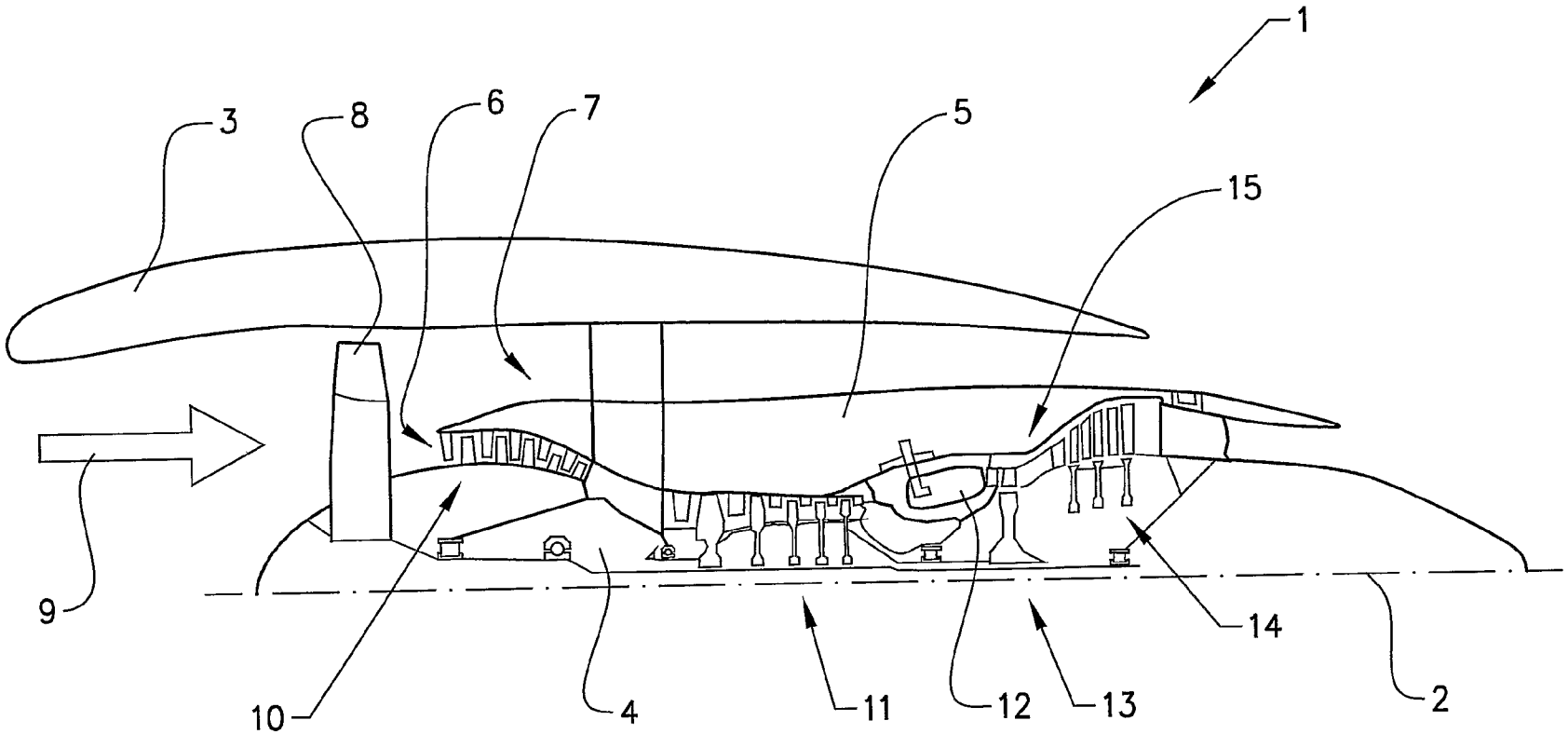
FIG. 1 is a schematic side view of the engine cut along a plane in parallel with the rotational axis of the engine.

The invention will below be described for a turbofan gas turbine aircraft engine 1, which in FIG. 1 is circumscribed about an engine longitudinal central axis 2. The engine 1 comprises an outer casing or nacelle 3, an inner casing 4 (rotor) and an intermediate casing 5 which is concentric to the first two casings and divides the gap between them into an inner primary gas channel 6 for the compression of air and a secondary channel 7 in which the engine bypass air flows. The casings are in turn made up of a plurality of components in the axial direction of the engine. Thus, each of the gas channels 6,7 is annular in a cross section perpendicular to the engine longitudinal central axis 2.

The engine 1 comprises a fan 8 which receives ambient air 9, a booster or low pressure compressor (LPC) 10 and a high pressure compressor (HPC) 11 arranged in the primary gas channel 6, a combustor 12 which mixes fuel with the air pressurized by the high pressure compressor 11 for generating combustion gases which flow downstream through a high pressure turbine (HPT) 13 and a low pressure turbine (LPT) 14 from which the combustion gases are discharged from the engine.

A high pressure shaft joins the high pressure turbine 13 to the high pressure compressor 11 to substantially form a high pressure rotor. A low pressure shaft joins the low pressure turbine 14 to the low pressure compressor 10 to substantially form a low pressure rotor. The low pressure shaft 17 is at least in part rotatably disposed co-axially with and radially inwardly of the high pressure rotor.

Figure 2:
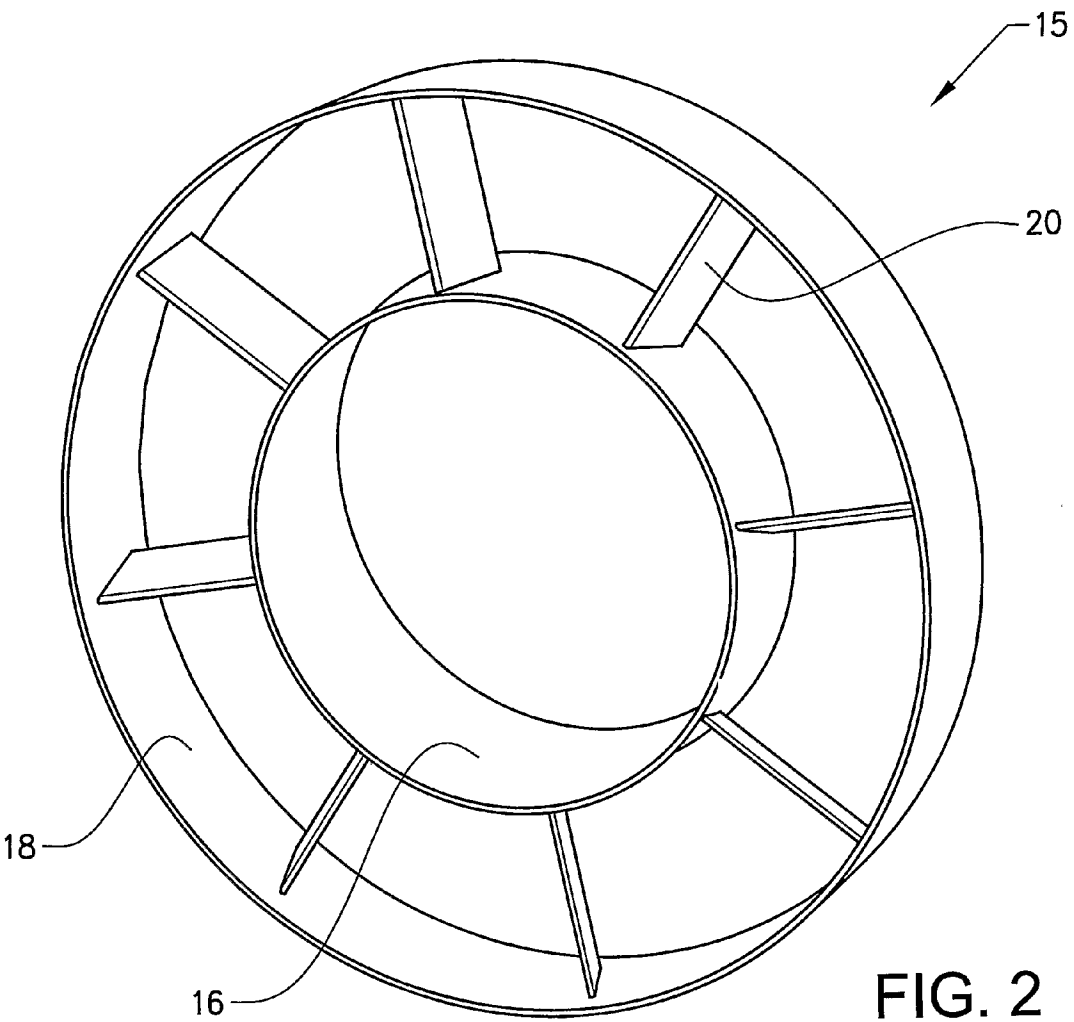
FIG. 2 is a schematic, perspective view of an intermediate housing component from FIG. 1.

An intermediate turbine housing 15 is positioned between the high pressure turbine 13 and the low pressure turbine 14, see FIG. 2. The component 15 comprises an inner ring 16, which forms part of the intermediate casing, an outer ring 18, which forms part of the inner casing, and a plurality of circumferentially spaced radial arms 20, which are rigidly connected to the inner and outer ring, respectively, see FIG. 2. These arms are generally known as struts. The struts 15,16 are structural parts, designed for transmission of both axial and radial loads and may be hollow in order to house service components. The housing 15 is designed for guiding the gas flow from the high pressure turbine radially outwards toward the low pressure turbine inlet.

Figure 4:
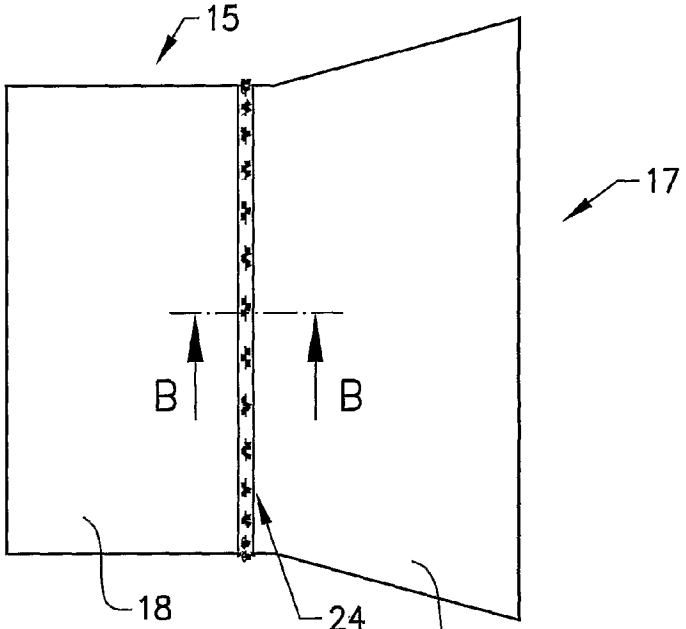
FIG. 4 is side view of the component in FIG. 3.
Figure 3:
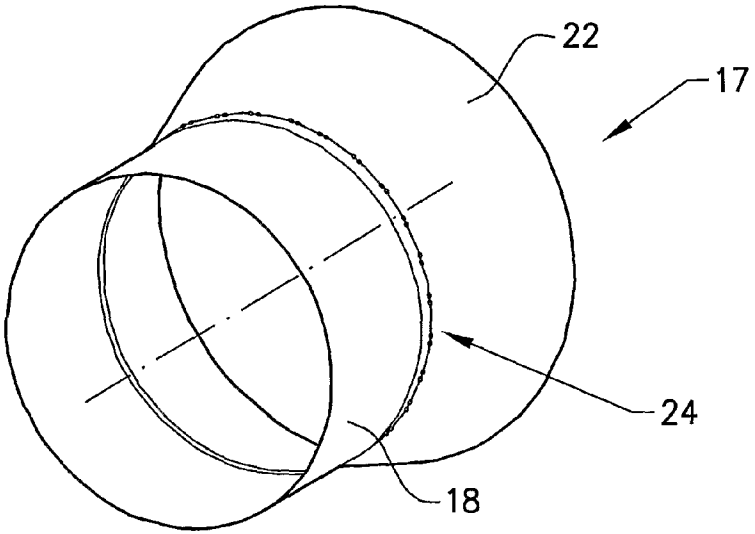
FIG. 3 is a schematic, perspective view of a connection of the component in FIG. 2 according to a first embodiment.
Figure 5:
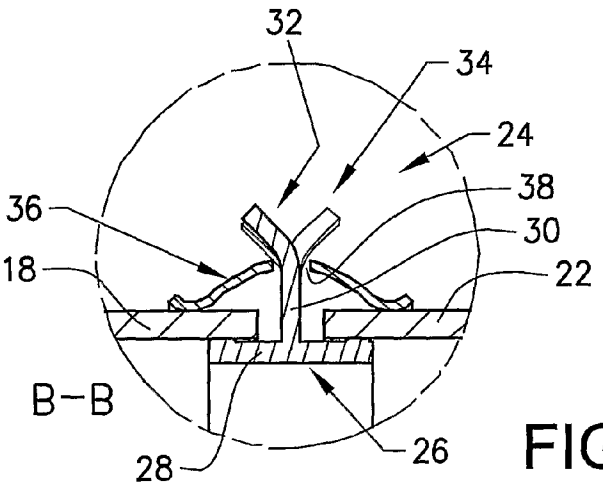
FIG. 5 is an enlarged cross sectional view of the connection arrangement of FIGS. 3 and 4.

FIGS. 3-5 show a gas turbine housing component 17. The component 17 comprises a surrounding wall structure, wherein the wall structure comprises two adjacent and spaced wall parts 18,22 and a connection arrangement 24 arranged between adjacent edges of the two wall parts. Thus, the wall structure extends in a circumferential direction of the component. More specifically, the wall structure is annular with a circular cross sectional shape in FIG. 3. The gas turbine housing component 17 is adapted to be positioned between two turbine stages. Further, the wall parts 18,22 are adapted to define a gas flow channel. A first annular wall part 18 forms part of the housing 15. A second annular wall part 22 is conical. The two wall part edges are arranged substantially flush with each other. Further, the wall parts 18,22 are arranged so that the wall part edges extend in a circumferential direction of the component. Each of the wall parts 18,22 may be formed by a cast or fabricated fairing segment, machined as requested to accomodate profile and thickness tolerances as well as surface roughness to ensure sliding and sealing.

The connection arrangement 24 comprises an elongated seal strip 26 positioned along the wall part edges, see FIG. 5. The seal strip 26 bridges the distance between the wall part edges. The connection arrangement 24 further comprises a support means 36 in the form of an elongated support strip 36, which is also positioned along the wall part edges. The support strip 36 forms a flexible element, i.e. a spring element. The seal strip 26 and the support strip 36 are positioned on opposite sides of the wall parts 18,22 and interconnected so that a gap between the wall parts is enclosed.

More specifically, the support strip 36 and the seal strip 26 are connected in such a manner that the seal strip 26 is pressed against both wall parts. The support strip 36 has a curved shape in cross section, forming a cavity facing the wall parts. The seal pressure and thus function is improved by the internal cavity pressure on the support strip side.

The support strip 36 and the seal strip 26 are connected in such a manner that at least one of them contacts surfaces on both sides of the gap. More specifically, the support strip 36 contacts surfaces on both sides of the gap on an exterior side of the wall and the seal strip 26 contacts surfaces on both sides of the gap on an interior side of the wall. In other words, the first portion of the seal strip acts on a radially inner side of the wall parts.

The seal strip 26 comprises a first portion 28 bridging the distance between the wall part edges on a first side (interior side) of the wall parts and a second portion 30 extending from the first portion between the wall part edges to a position on a second side (exterior side) of the wall parts. The first portion 28 is designed to follow the contour of the wall parts. The first portion 28 is in this case substantially flat in cross section and has an extension in parallel to the wall parts 18,22. The second portion 30 extends substantially perpendicularly in relation to a transverse direction of the first portion 28. Thus, the seal strip has the general shape of a T in cross section.

The support strip 36 comprises at least one through hole 38 and the second portion 30 of the seal strip 26 extends through said hole. More specifically, the support strip 36 comprises a plurality of through holes spaced in a longitudinal direction of the support strip. Especially, the holes form slots.

The second portion of the seal strip 26 comprises at least two flat fingers, or tabs, 32,34, which act on the support strip 36 on opposite sides of the through hole 38. Said at least two fingers 32,34 act on a surface of the support strip 36 facing away from the wall parts. More specifically, the second portion of the seal strip 26 comprises a plurality of sets of fingers and each finger set is positioned in an individual through hole. According to the preferred embodiment, at least one set of fingers (and preferably all sets) comprises three fingers, wherein a first intermediate finger acts on a first side of the through hole and a second and third finger on opposite sides of the first finger act on a second side of the through hole. Three fingers, preferably of size 50%- 100% -50% in the longitudinal direction of the strip would eliminate any induced torque.

For assembly, the wall parts 18,22 are assembled in a fixture to an appropriate gap, for example 4 mm in cold conditions. The seal strip 26 is assembled from the inside in the gap and the support strip 36 is attached from the outside. The fingers of the seal strip 26 are thereafter positioned into the slots in the support strip. A prestress pressure is applied to the connection arrangement by hand or by a separate calliper tool. The tabs are bent, for example by a hydraulic tool to create a prestress between the seal strip 26 and the walls 18,22 and between the support strip 36 and the walls 18,22, respectively.

According to an alternative to the embodiment in FIG. 3-5, the wall parts are arranged so that the wall part edges extend in an axial direction of the component. Especially, the wall parts defining the gap may form part of the same wall element. In other words, a one-piece wall element may be curved so that its ends define the gap.

Figure 6:
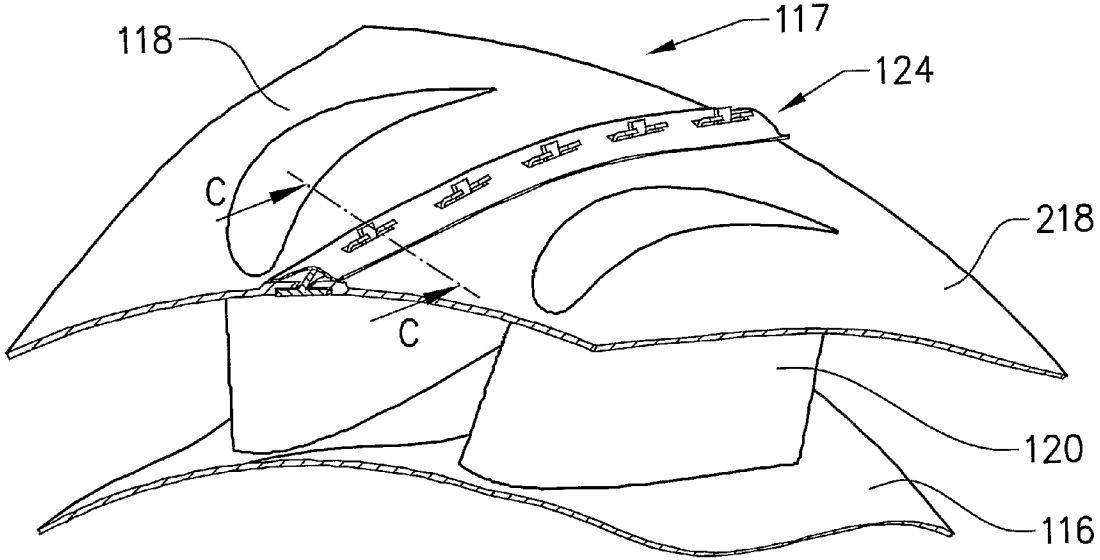
FIG. 6 is a partly cut perspective view of a connection of the component in FIG. 2 according to a second embodiment.
Figure 7:
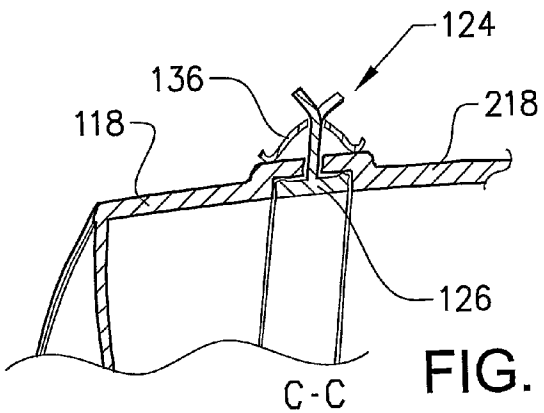
FIG. 7 is an enlarged cross sectional view of the connection arrangement of FIG. 6.

FIGS. 6 and 7 show a second embodiment of a gas turbine housing component 117. The component 117 comprises an annular wall structure, which comprises an inner wall 116 and an outer wall 118,218. A plurality of circumferentially spaced struts 120 are arranged between the inner and outer walls 116,118,218. The outer wall comprises two wall parts 118, 218. The edges of the outer wall parts 118,218 extend in an axial direction of the component 117. Thus, the seal strip 126 extends in the axial direction of the component 117. Each of the two wall parts 118,218 comprises an inner cavity for receiving the first portion of the seal strip 126. The cavities are designed with respect to the configuration of the first portion of the seal strip so that an inner surface of the seal strip is substantially flush with the inner surface of the wall parts 118,218. More specifically, each of the wall parts 118,218 comprises an outwardly bent portion facing the gap. This outwardly bent portion comprises said cavity. The seal strip 126 and the support strip 136 are of similar design as the embodiment described above for the first embodiment.

Figure 8:
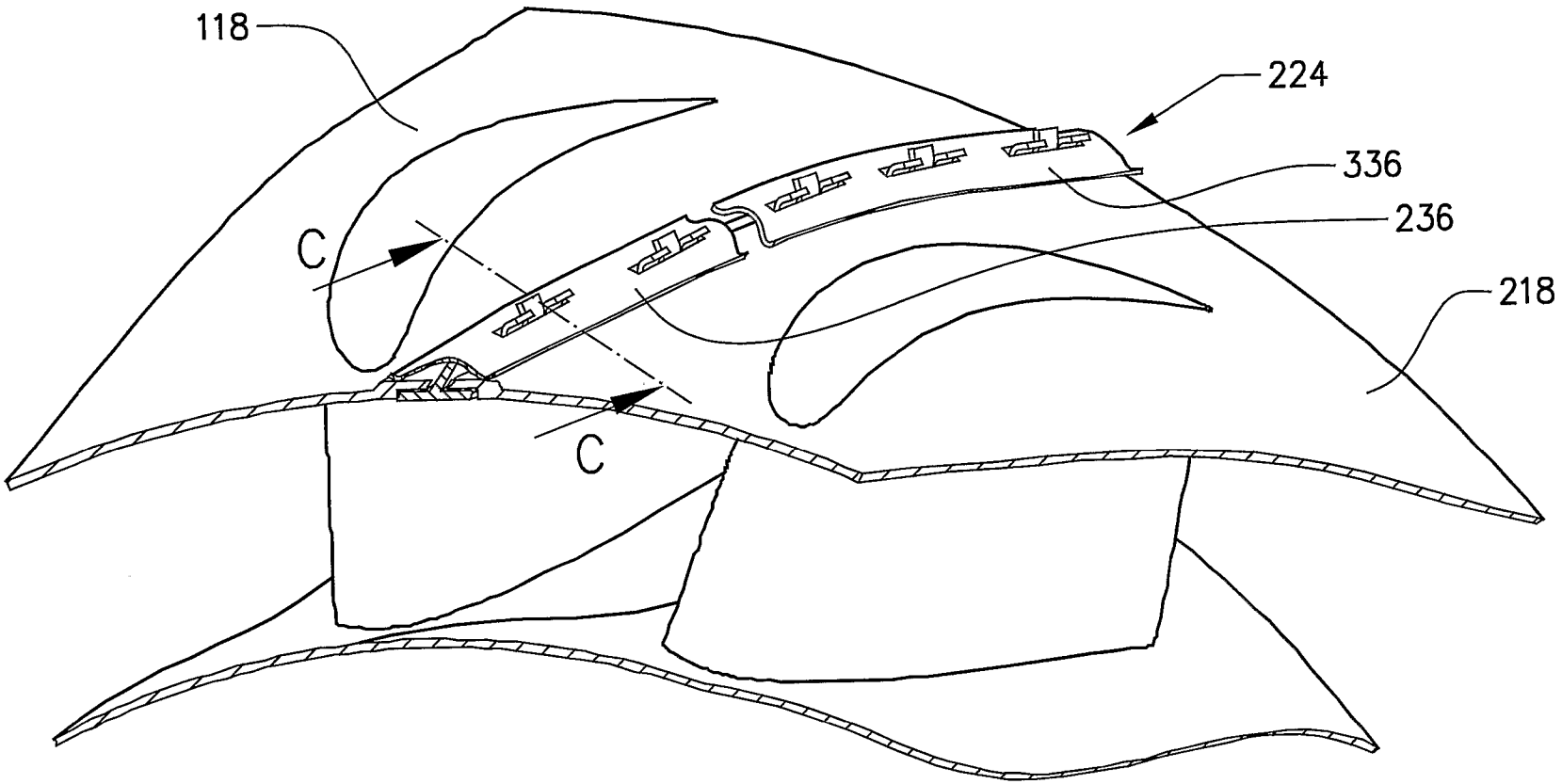
FIG. 8 is an alternative embodiment to the second embodiment.

FIG. 8 shows an alternative embodiment to the second embodiment. Only the difference relative to the second embodiment will be described below. The connection arrangement 224 comprises a plurality of elongated support strips 236,336, which are spaced in the longitudinal direction of the gap between the wall parts 118,218. Thus, the support strips 236,336 are spaced in their longitudinal direction. Each of the support strips 236,336 comprises at least one hole for accommodating a set of fingers extending from the associated seal strip.

According to an alternative to the embodiment shown in FIG. 8, the support means 36 comprises a plurality of support elements, which do not need to be formed by an elongated strip, spaced in the longitudinal direction of the seal strip. Each such support element comprises at least one hole for receiving one set of fingers.

The invention is not limited to the position between two turbine stages. Further applications may be for the ducts of a Turbine Center Frame, Turbine Mid Frame and a Turbine Housing.

The invention is not in any way limited to the above described embodiments, instead a number of alternatives and modifications are possible without departing from the scope of the following claims.

According to an alternative to the embodiments shown, where each set of fingers comprises three fingers, each set may comprise only one finger, wherein the fingers in are bent in opposite directions in consecutive holes.

According to a further alternative, each set may comprise two fingers, wherein the two fingers are bent in opposite directions from an individual hole. This design counteracts bending forces.

According to a further alternative, the component comprises a wall structure, which does not have a circular cross sectional shape. Specifically, the wall structure may form a surrounding structure with a polygonal, faceted, sinusoidal or any other cross sectional shape.

The invention claimed is:

1. A gas turbine housing component, comprising a wall structure, wherein the wall structure comprises two adjacent wall parts and a connection arrangement arranged between adjacent edges of the two wall parts, wherein the connection arrangement comprises an elongated seal strip positioned along the wall part edges and bridging the distance between the wall part edges, wherein the connection arrangement comprises a support means, which is connected to the seal strip and adapted to hold the seal strip in the position along the wall part edges, and that the seal strip and the support means contact the wall parts on opposite sides thereof, wherein the seal strip comprises a first portion bridging the distance between the wall part edges on a first side of the wall parts and a second portion projecting from the first portion between the wall part edges, and the support means comprises at least one through hole, and that part of the second portion of the seal strip extends through the hole and is adapted to hold the seal strip in the position along the wall part edges, and wherein the e second portion of the seal strip comprises at least two fingers, which act on the support means on opposite sides of the through hole.

2. A gas turbine housing component according to claim 1, wherein the support means comprises at least one elongated support strip.

3. A gas turbine housing component according to claim 2, wherein the seal strip and the support strip are interconnected so that a gap between the wall parts is enclosed.

4. A gas turbine housing component according to claim 1, wherein the support means forms a flexible element.

5. A gas turbine housing component according to claim 1, wherein the support means and the seal strip are connected in such a manner that the seal strip is pressed against both wall parts.

6. A gas turbine housing component according to claim 1, wherein the first portion of the seal strip acts on a radially inner side of the wall parts.

7. A gas turbine housing component according to claim 1, wherein the second portion extends substantially perpendicularly in relation to a transverse direction of the first portion.

8. A gas turbine housing, component according to claim 1, wherein the first portion is designed to follow the contour of the wall parts.

9. A gas turbine housing component according to claim 1, wherein the support means comprises at least one elongated support strip, and the support strip comprises a plurality of through holes spaced in a longitudinal direction of the support strip.

10. A gas turbine housing component according to claim 1, wherein the two wall parts are arranged flush with each other.

11. A gas turbine housing component according to claim 1, wherein the wall part edges extend in a circumferential direction of the component.

12. A gas turbine housing component according to claim 1, wherein the wall part edges extend in an axial direction of the component.

13. A gas turbine housing component according to claim 1, wherein the wail parts are adapted to define a gas flow channel.

14. A as turbine housing component according to claim 1, wherein the component comprises a plurality of circumferentially spaced struts and that at least one of the struts is joined to at least one of the wall parts.

15. A as turbine engine wherein it comprises a gas turbine housing component according to claim 1.

16. A gas turbine engine according to claim 15, wherein the gas turbine housing component is positioned between two turbine stages.

* * * * *